United States Patent [19]

Eklund et al.

[11] 4,064,787

[45] Dec. 27, 1977

[54] MAGAZINE FOR A MOBILE FIREARM

[75] Inventors: John Folke Eklund; Sven-Håkan Svensson, both of Karlskoga, Sweden

[73] Assignee: AB Bofors, Bofors, Sweden

[21] Appl. No.: 722,256

[22] Filed: Sept. 10, 1976

[30] Foreign Application Priority Data

Sept. 12, 1975 Sweden ..... 7410204

[51] Int. Cl.[2] ..... F41H 7/06

[52] U.S. Cl. ..... 89/34; 89/33 A; 89/33 SF; 89/36 H; 89/46; 89/47; 198/655

[58] Field of Search ..... 89/33 A, 33 B, 33 BB, 89/33 SF, 34, 36 H, 36 K, 36 L, 40 B, 45, 46, 47; 198/655, 656

[56] References Cited

U.S. PATENT DOCUMENTS

| | | | |
|---|---|---|---|
| 756,272 | 4/1904 | Noble | 198/655 |
| 2,474,975 | 7/1949 | Goodhue | 89/33 SF |
| 2,933,981 | 4/1960 | Anderson et al. | 89/36 H |
| 3,724,324 | 4/1973 | Zielinski | 89/36 K |

*Primary Examiner*—Stephen C. Bentley

*Attorney, Agent, or Firm*—Pollock, Vande Sande & Priddy

[57] ABSTRACT

A device for a magazine comprises a number of tubular containers which are arranged in an endless chain, intended to contain rounds, and provided with blocking members for fixing the respective rounds in the longitudinal direction in the containers, driving devices for driving the containers around in the magazine, and a releasing device which in a common feed-out position for the rounds in the magazine can coact with the blocking members of the containers.

7 Claims, 9 Drawing Figures

MAGAZINE FOR A MOBILE FIREARM

BACKGROUND OF THE INVENTION

The invention is primarily intended to be utilized for a magazine for a tank, for which there is often a desire that the magazine in question can be arranged with a common feed-out position. More specifically, the invention relates to magazines of the type which are suspended on the outside of a tank. In such applications it is desirable to prevent fires from spreading inside the magazine, also, there is usually a requirement that the magazine can be loaded with ammunition of different kinds, without having any negative effect on the speed at which rounds can be fed out and, accordingly, the rate of fire of the firearm of the tank.

SUMMARY OF THE INVENTION

The present invention is concerned with this problem, and an arrangement is proposed in which the releasing device has the form of a stop located in the feed-out position. A container when actuated to the common feed-out position is arranged to fall in such a way against this stop that its blocking member enters into releasing coaction with the stop.

BRIEF DESCRIPTION OF THE DRAWINGS

An embodiment proposed at present of a device which has the characteristics significant for the invention will be described in the following, with reference to the accompanying drawings, in which.

DETAILED DESCRIPTION OF THE PREFERRED EMBODIMENT

Figure 1:
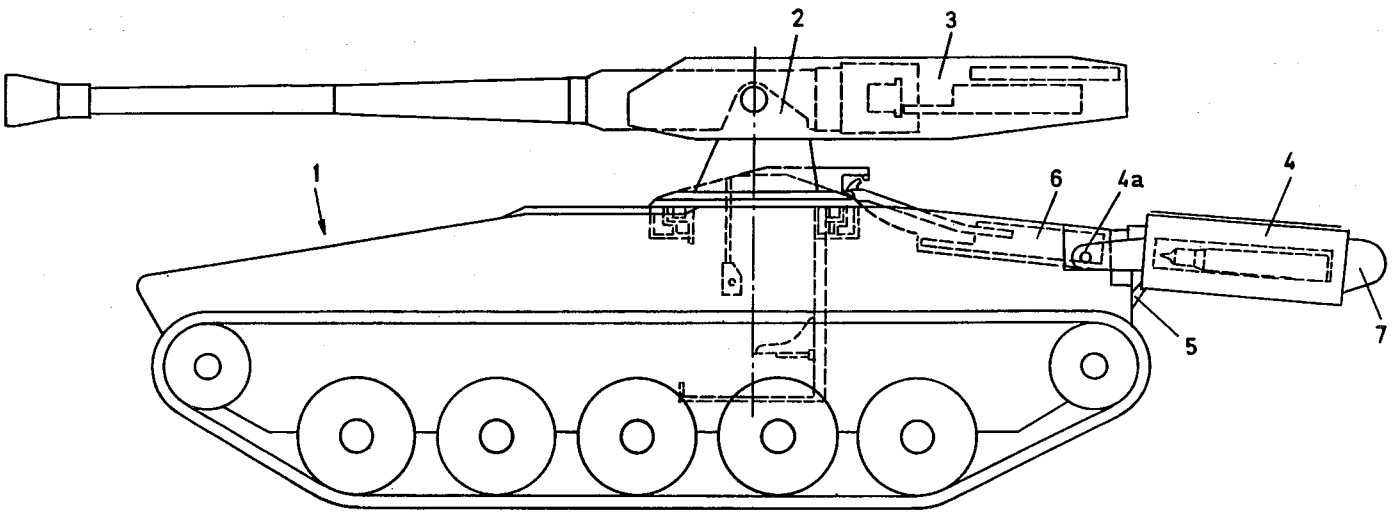
FIG. 1 shows a side view of a tank provided with a magazine utilizing the invention.

In FIG. 1, a tank includes a turret mount 2 supporting a firearm 3. The turret mount is rotatable in traverse in relation to the chassis of the tank. At the rear, the tank is provided with a magazine 4 of the type which is suspended on the outside of the tank and which can be swung up vertically in relation to the tank chassis by means of one or several hydraulic cylinders 5. The magazine is supported in the tank chassis via journals 4*a* (one on each side) so that the magazine is non-rotatable laterally in relation to the chassis. A loading pendulum 6 mounted on the outside (upper side) of the tank is arranged in such a way that it automatically transfers rounds from a receiving position at the magazine as shown in FIG. 1, to a ramming position at the firearm. As the function of the loading pendulum is not directly concerned with the present invention, it will not be described in detail.

The magazine is provided with a rammer or feed-out unit 7 which is known in itself and which is arranged to transfer a round set in the feed-out position to the loading pendulum with the point first.

Figure 2:
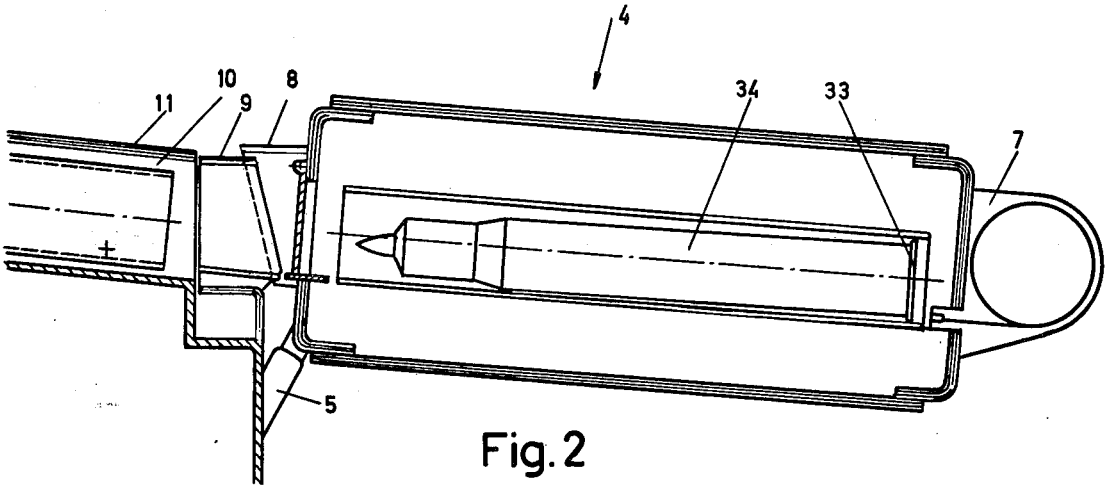
FIG. 2 shows an enlarged vertical view partly in cross-section of the magazine on the tank according to FIG. 1.
Figure 3:
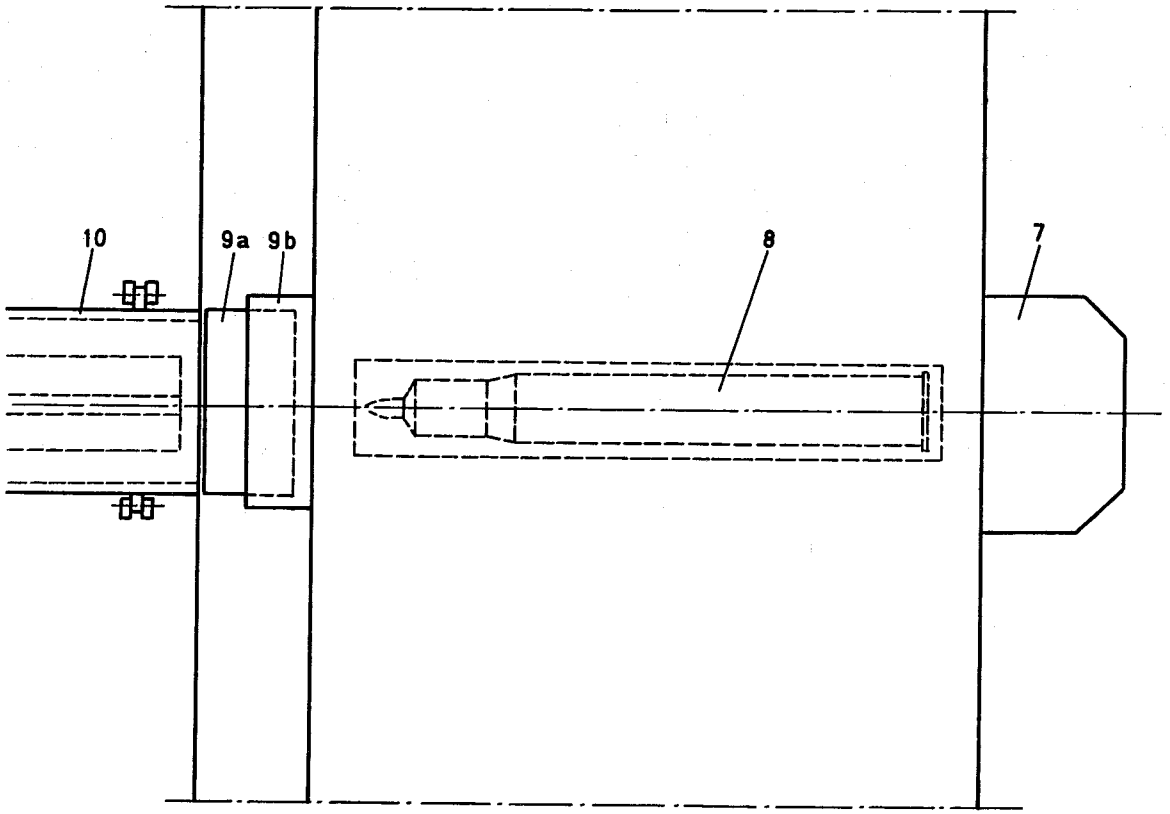
FIG. 3 shows a partial view of the parts of the magazine according to FIG. 2.

FIGS. 2 and 3 show the magazine in more detail. As shown in FIG. 2, the magazine is made with top, walls and bottom of heavy armour plate. In FIG. 3, a common, centrally located feed-out position for the rounds is shown with a round 34 in place for feed-out. The feed-out of the rounds takes place via a channel formed by tubes 8 and 9 with progressively decreasing diameters, which permits feed-out at different angular positions of the magazine in relation to the tank chassis. The channel aligns generally to a shaft 10 in the tank chassis in which the loading pendulum 6 rests in its receiving position; shaft 10 also serves as a rest position for the loading pendulum when it is not being utilized for loading of the firearm. The shaft 10 is made with covers 11 which can be opened and closed and which are intended to prevent foreign objects, water etc. from entering into the shaft. The tubes 8, 9 and the covers 1 are also made of heavy armour plate. At its round-carrying sections, the loading pendulum is made in the form of an armour tube with open ends, which permits rounds to be fed into it from the magazine.

Figure 4A:
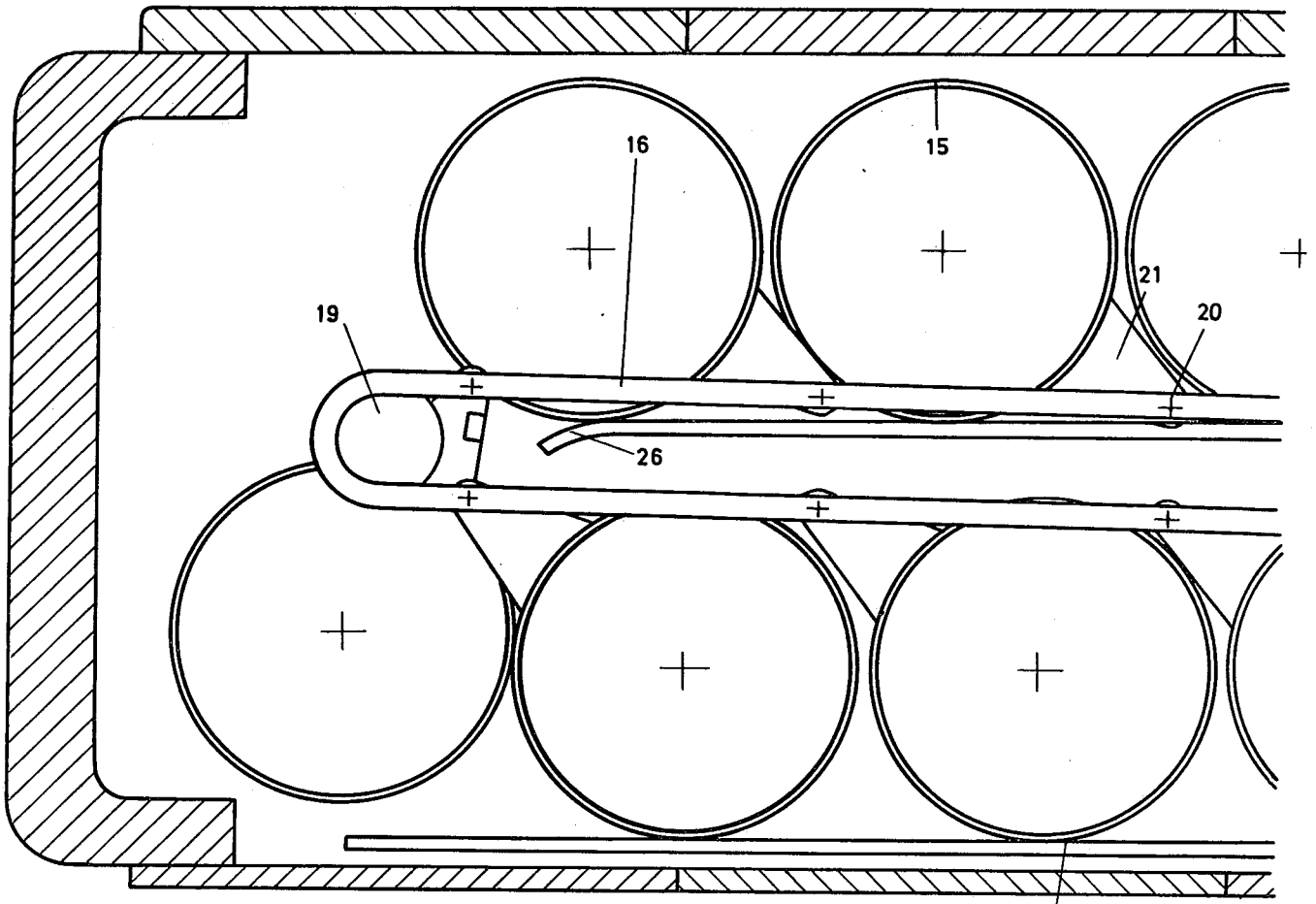
FIGS. 4*a*–4*c* show an enlarged vertical views partly in cross-section of a detailed embodiment of the internal parts of the magazine according to FIGS. 1–3 (FIGS. 4*a*–4*c* placed beside each other with FIG. 4*a* farthest to the left and FIG. 4*b* in the middle)
Figure 4B:
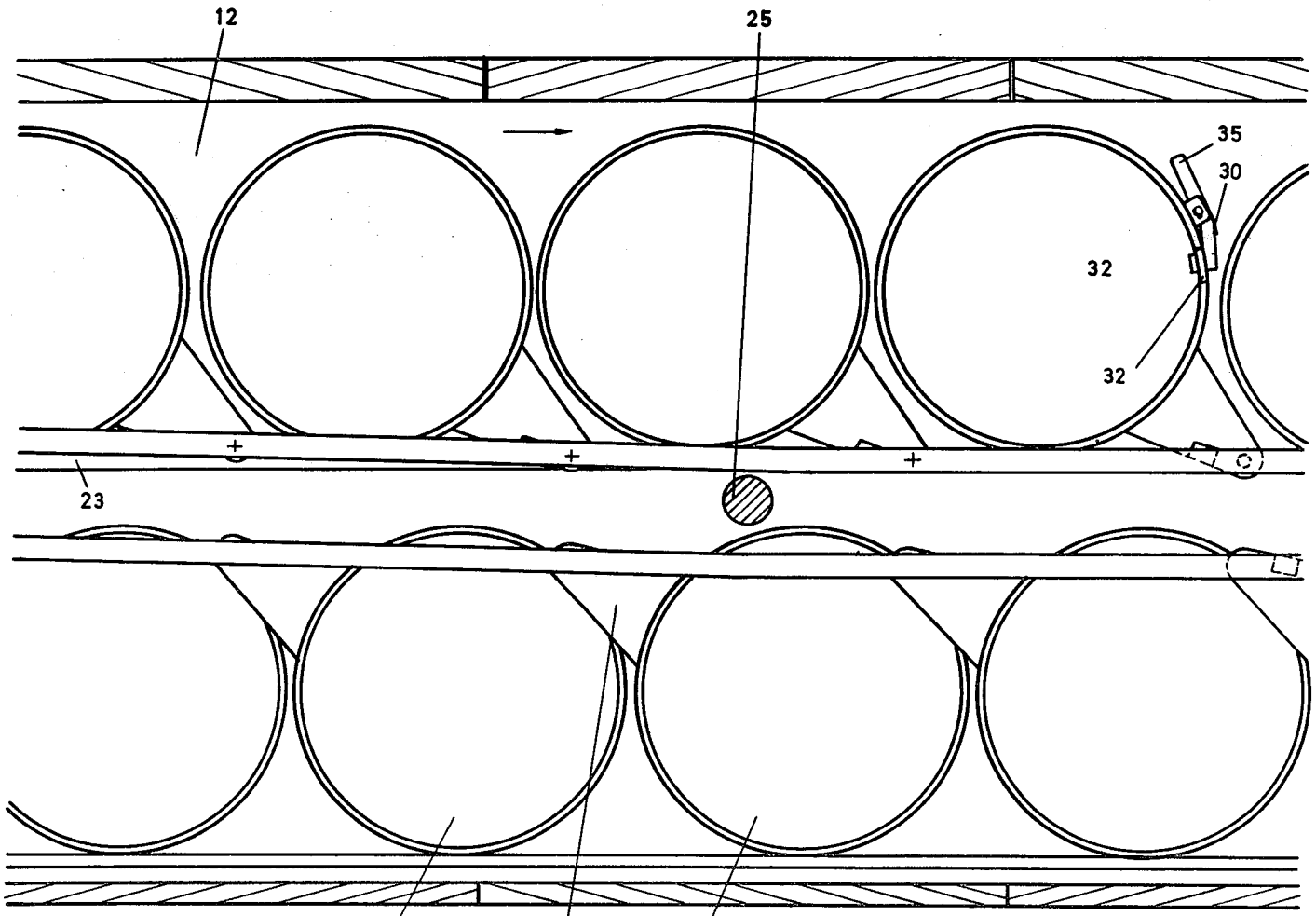
Figure 4C:
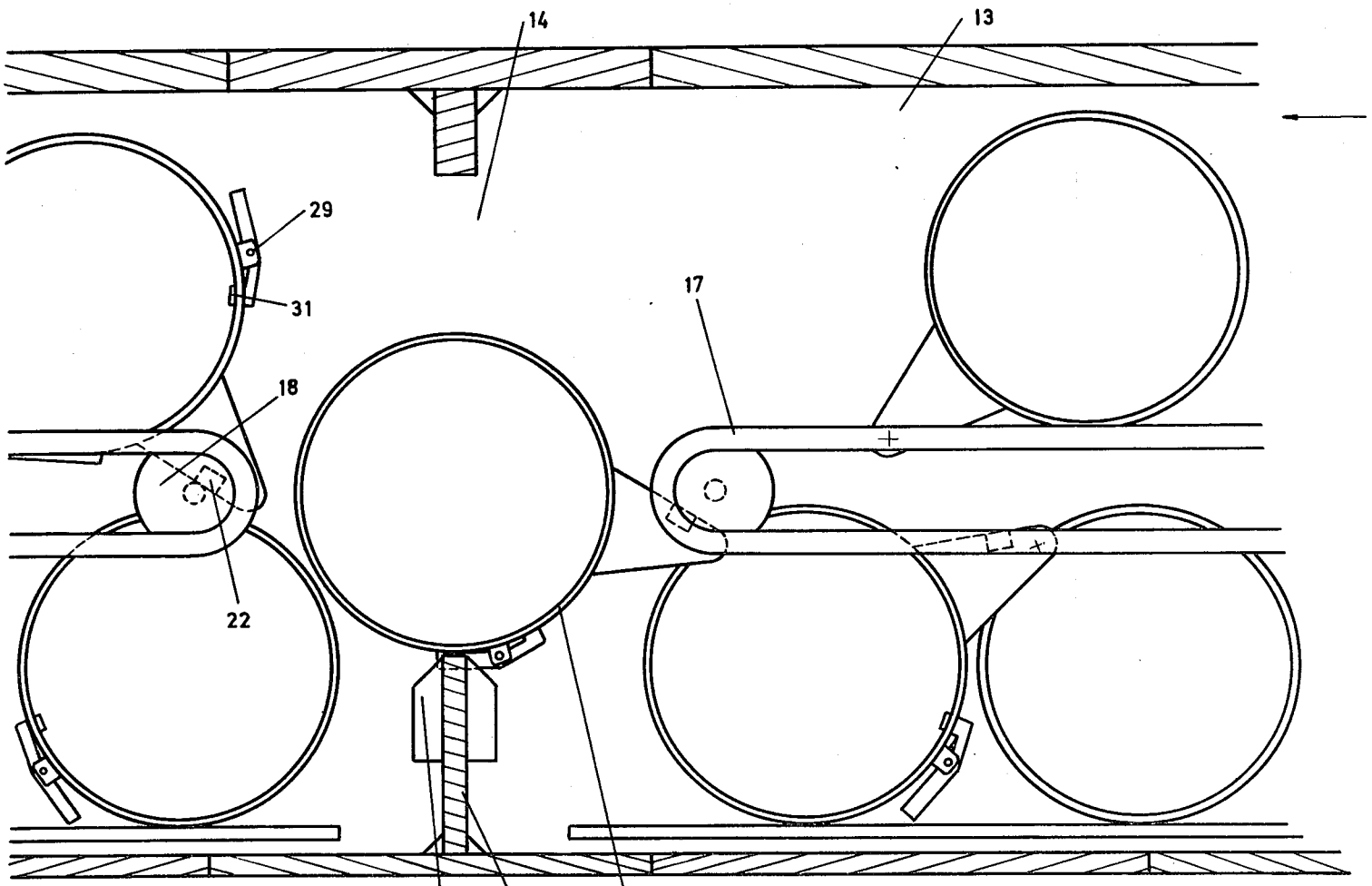

As shown in more detail in FIG. 4*a* to 4*c*, the top and bottom of the magazine are made with blow-out covers which give way to increases of the pressure in the magazine. The magazine is divided into two magazines compartments 12 and 13, of which the latter is only partly shown. The feed-out position is between the magazine compartments, and has been designated 14.

In order to prevent fires from spreading within or between the magazine compartments, the rounds are inserted in tubular containers 15, which consist of heavy armour tubes. In each magazine compartment, the containers are arranged on an endless chain which is driven around in the magazine compartment by means of driving members. Each chain of containers is driven by two driving chains arranged on either end of the containers. In FIG. 4, only one of the driving chains of the respective container chains is shown in each magazine compartment 12, 13 the driving chain in magazine compartment 12 having been given the designation 16, and the driving chain in magazine compartment 13 having been given the designation 17. Each driving chain has pulleys 18, 19, which are small in relation to the cross-section of the container. Pulleys 18, 19 are supported in the front wall of the magazine facing the loading pendulum, and the pulleys in magazine compartment 12 not shown in FIG. 4 are supported in the rear wall of the magazine; so that, the space between the pairs of pulleys for the coacting driving chains will be open. The containers are rotatably fastened in the chain at a points 20. The fastening is achieved by means of a fastening lug 21 which extends at right angles in relation to the longitudinal direction of the container. The fastening lug 21 on each container is located on an extended part of the container, so that during movement of the container chain the fastening lug can extend past the end edge of an adjacent container. See, for example, the fastening lug 21′ on the container 15′ which extends past the end edge of the adjacent container 15″. The fastening lug is fastened to the driving chain by means of a journal not shown in detail, around which the fastening lug and the container can rotate. Each fastening lug is made with a recess 22 which can coact with an extended journal at the pulley 18 in order to facilitate the turning down of the upper containers in the endless container chain to the feed-out position. The feed-out position is shown by means of the container 15''' for the container chain of magazine compartment 13. The containers, which are held at fixed angles in the endless chain in dependence on their position in the respective magazine compartment, are pulled through the magazine along two plates 23 and 24, the upper plate 23 supporting the containers in the upper row of course of endless chain and the lower plate 24 supporting the containers in the endless chain. The upper plate is supported at its central parts by means of a supporting beam 25 extending between the front and rear walls of the magazine, and the upper plate is also made with a certain spring action at its ends, which facilitates the driving of the endless container chain. The plate 25 is also made with a depressed part 26 at the end facing away from the common feed-out position, which facilitates pulling the containers up onto the upper plate. Also the lower plate is supported in the front and rear walls of the magazine. The driving of the driving chains can be carried out by means of electric motors or hydraulic motors in ways which are known in themselves. The driving members, containers and their fastening devices in the driving member have identical embodiments in the two magazine compartments. However, the directions of the driving in the two magazine compartments are opposite to each other; and thus the driving direction seen from the view according to FIG. 4 is clockwise in magazine 12 and counter-clockwise in magazine compartment 13.

Figure 5:
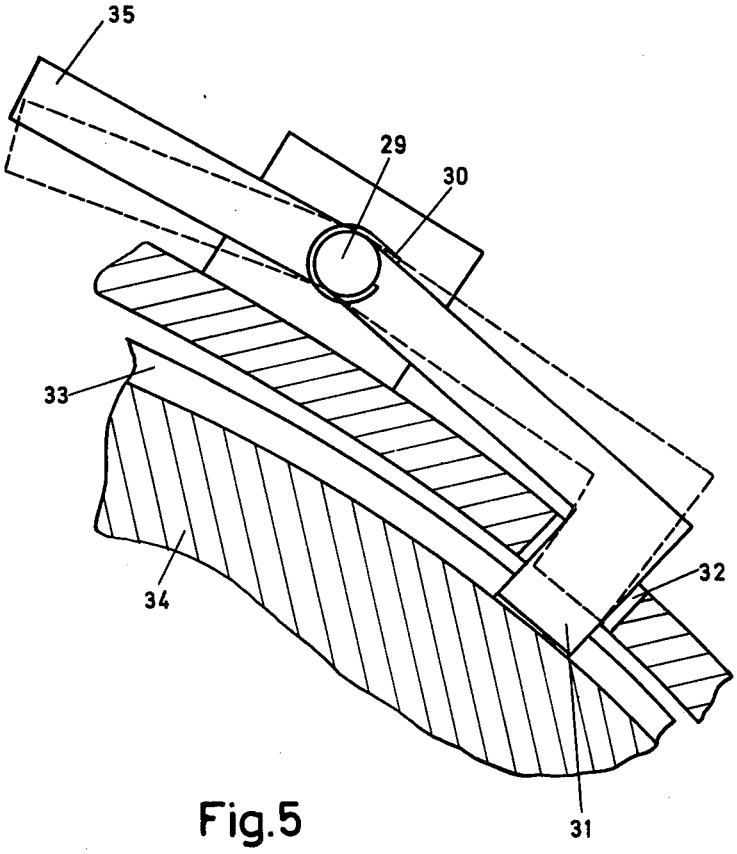
FIG. 5 shows an enlarged vertical view partly in cross-section of the blocking members arranged on the containers according to FIGS. 4*a*–4*c*.
Figure 6:
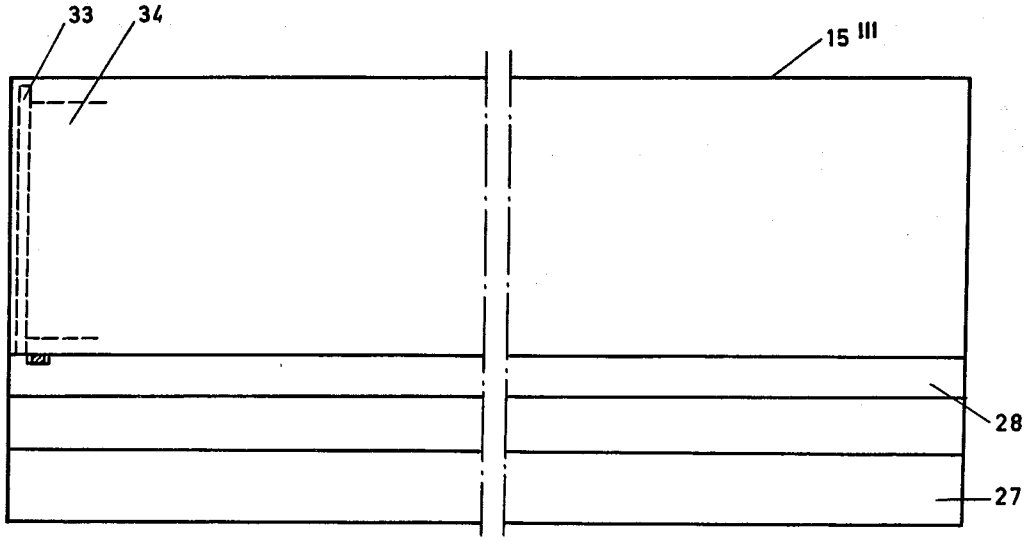
FIG. 6 shows a side view of the parts comprised in the magazine according to FIG. 4*a*–4*c*.

Each container is provided with a blocking member near its rear end primarily shown in FIG. 5, which in its rest position (indicated with solid lines) is intended to secure a round 34 inserted in the container in the longitudinal direction through coaction with the rear cartridge case flange 33 of the round. The blocking member can be released in the container in the feed-out position when it falls against a stop placed centrally in the feed-out position. The stop comprises an upright part 27 which is fastened at its lower end in the bottom of the magazine. At the top, the stop is provided with angled guide surfaces 28, which make it easier for the containers to slide down from the stop. FIG. 6 shows the stop and the container 15''' viewed from the side from the magazine compartment 12. The stop extends along the entire length of the container the stop preferably is positioned so that the centerline of a round in the feed-out position falls in the plane containing the axes of rotation of pulleys 18 and 19. This arrangement minimizes the overall height of the magazine.

The blocking member on each container consists of an arm which is rotatably supported at its central parts by means of a journal 29. The arm is kept depressed in a first position (shown with solid lines in FIGS. 5), where a stud 31 fastened to one free end of the arm is pressed through a recess 32 in the wall of the container. In this position, stud 31 coacts with the rear cartridge case flange 33 of a round inserted in the container to prevent movement of the round. A spring 30 is mounted on journal 29 and presses against the arm at one end, while its other end is fastened in the protruding supporting parts for the supporting journal 29. It is also conceivable to allow the stud to have the form of a gripping claw which can coact with the cartridge case flange.

Figure 7:
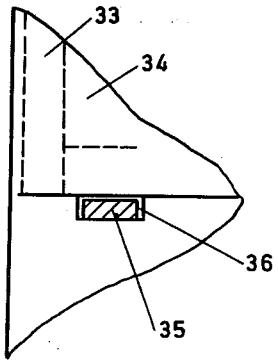
FIG. 7 shows an enlargement of details of the parts according to FIG. 6.

The driving and the fixing of the positions of the containers is then arranged in such a way that when a container falls down from the upper plate 23 to the position assumed by the container 15''' in FIG. 4, the second, free end 35 of the arm will go against the stop so that the arm is actuated against the bias spring 30 and assumes a second position shown with dash lines in FIG. 5. At this second position, the stud 31 releases its grip against the cartridge case flange 34. The round in question can thereafter be pushed out of the tube by means of the expelling device 7 (FIG. 1). After the round has been fed out, the container is pulled down to the lower plate 24 and the spring 30 returns the arm to the first, or rest, position. In order to prevent the entire weight of the container and the round contained in it from being placed on the blocking member in question, the stop is made with a recess 36, especially shown in FIG. 7, arranged to ensure that the actuation of the end 35 of the arm is obtained, without the arm in question being subjected to excessive loading forces.

The design shown of the magazine, in addition to preventing fires from spreading, permits loading of the magazine with ammunition of various kinds. Thus, the containers in part magazine 12 can be provided with a first kind and the containers in part magazine 13 with a second kind of ammunition.

The invention is not limited to the example of an embodiment shown above, but can be subject to modifications within the scope of the accompanying claims.

We claim:

1. A magazine for delivering rounds to a feed-out position, comprising:

at least one endless chain having upper and lower courses, said chain being mounted for rotation with said upper course moving toward said feed-out position;

a plurality of tubular containers mounted on said at least one endless chain for movement therewith, each container being pivotably mounted by means of a respective fastening lug which extends laterally of the container in the direction of movement of said at least one endless chain and is pivotably attached to said at least one endless chain;

a stop located at said feed-out position and adapted to contact and support each sucessive one of said plurality of containers as each container pivots on its fastening lug away from said at least one endless chain and drops into said feed-out position; and at least one blocking member mounted on each of said plurality of containers for preventing movement of rounds in said containers until said feed-out station is reached, each blocking member being positioned on its container for contact with and release by said stop when said container drops into said feed-out position.

2. A magazine according to claim 1, wherein said stop is provided with at least one angled guide surface to facilitate movement of containers past said stop following feed-out of a round therefrom.

3. A magazine according to claim 1, further comprising a pair of spaced plate members for said at least one endless chain, one plate member below said upper course for supporting said containers as they move toward said feed-out position and one plate member below said lower course for supporting said containers as they move away from said feed-out position.

4. A magazine according to claim 1, wherein there are two magazine compartments, one on either side of said feed-out position, one compartment having an endless chain for moving containers toward said feed-out position from one side and the other compartment having another endless chain for moving containers toward said feed-out position in the opposite direction from the other side, said stop being located to contact and support containers received from either side of said feed-out position, whereby said magazine may be used alternately to feed different types of rounds.

5. A magazine according to claim 1, wherein said at least one endless chain runs on drive pulleys which are small in relation to the cross-section of each container, whereby said upper and lower courses are close together; and said stop is positioned in relation to said drive pulleys such that a plane through the axis of rotation of said pulleys coincides with the center-line of a container supported by said stop, whereby the overall height of said magazine is minimized.

6. A magazine according to claim 1, wherein said blocking member comprises a spring loaded arm supported at its center part and applied to the outside of its respective container, said arm having at one end a stud positioned to extend through a recess in said container and to engage a round positioned therein, and at the other end a portion positioned to contact said stop when the container drops into said feed-out position and thereby pivot said stud out of engagement with the round to permit feed-out.

7. A magazine according to claim 6, wherein said stop comprises a recess for receiving said portion at the other end of said arm, whereby said blocking member is not subjected to excessive loadings when the container drops into said feed-out position.

* * * * *